United States Patent [19]

Holden, Jr. et al.

[11] 3,938,726

[45] Feb. 17, 1976

[54] NESTING INSULATED HOT-OR-COLD FOOD TRAY

[75] Inventors: Morell J. Holden, Jr.; Frank LeBoutillier, both of Canandaigua, N.Y.

[73] Assignee: Mobil Oil Corporation, New York, N.Y.

[22] Filed: June 20, 1974

[21] Appl. No.: 481,095

[52] U.S. Cl. ..... 229/2.5 R; 229/3.1

[51] Int. Cl.[2] ..... B65D 1/26; A44B 17/00

[58] Field of Search ..... 229/2.5, 3.1

[56] References Cited

UNITED STATES PATENTS

| | | | |
|---|---|---|---|
| 1,748,911 | 2/1930 | Chaplin | 229/2.5 |
| 1,945,397 | 1/1934 | Gray | 229/2.5 |
| 2,915,214 | 12/1959 | Frankel | 229/3.1 S |
| 3,342,397 | 9/1967 | Duitsman | 229/2.5 |
| 3,442,433 | 5/1969 | Lombardi et al. | 229/2.5 |
| 3,511,433 | 5/1970 | Andrews et al. | 229/2.5 |
| 3,786,982 | 1/1974 | Rakes et al. | 229/2.5 |

FOREIGN PATENTS OR APPLICATIONS

| | | | |
|---|---|---|---|
| 1,127,487 | 9/1968 | United Kingdom | 229/DIG. 14 |

*Primary Examiner*—Davis T. Moorhead
*Attorney, Agent, or Firm*—Charles A. Huggett

[57] ABSTRACT

An integral tray structure of expanded substantially rigid plastic foam material, typically polystyrene foam is formed to have a bottom plate surface, an upstanding surrounding, inclined rim and a laterally projecting flange formed on the rim, the flange having, around its periphery, spaced projections, and recess means which are so arranged that, upon inversion of a tray structure above another tray structure, a hollow, insulated chamber, to contain hot or cold food, is formed. The projecting and recess means can be used to lock the tray structures together, and the inclined rims permitting nesting of the tray structures within each other, for minimum space requirements of the tray structures themselves for transportation and storage. The projecting-recess means may be formed as tabs engaging notches, or perpendicularly projecting buttons engaging matching cut-outs.

9 Claims, 12 Drawing Figures

FIG. 3
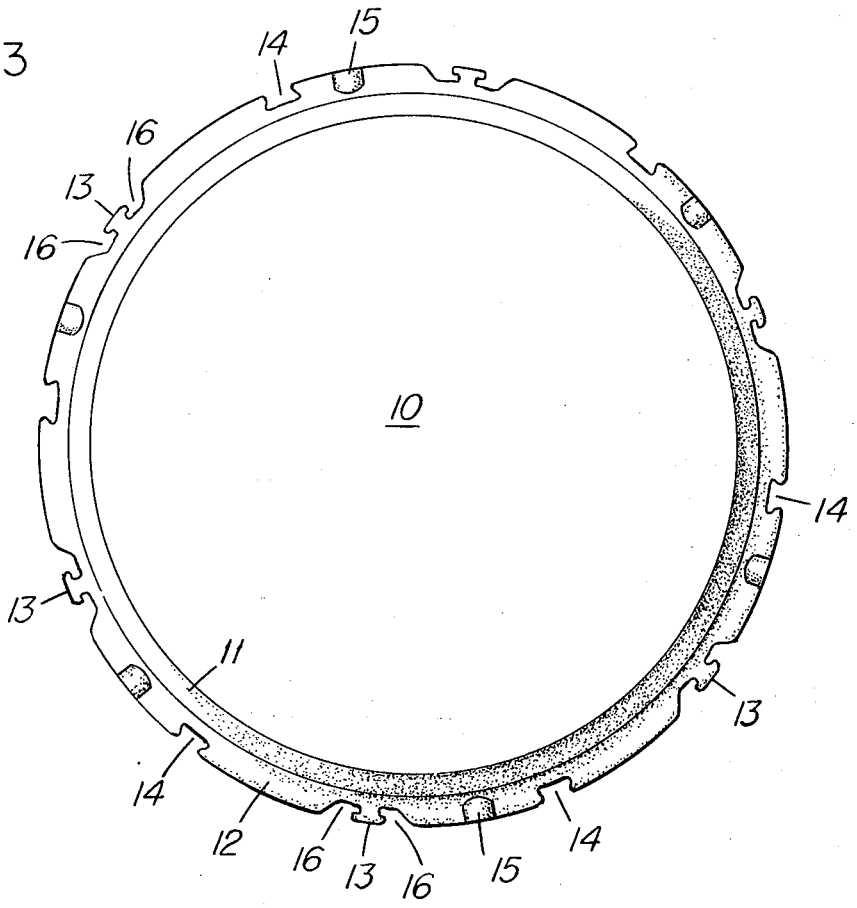
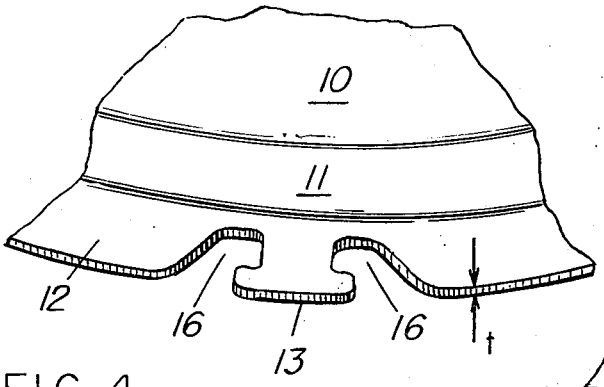
FIG. 4
FIG. 5
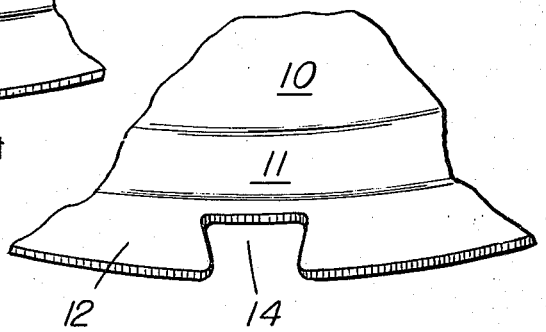

FIG. 8
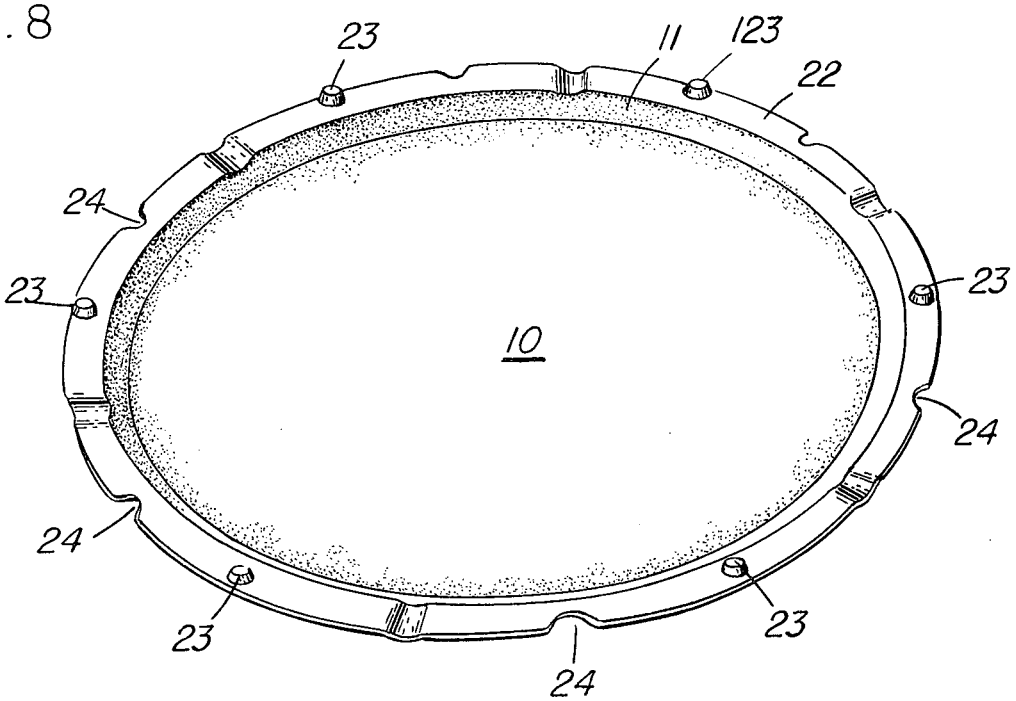
FIG. 9
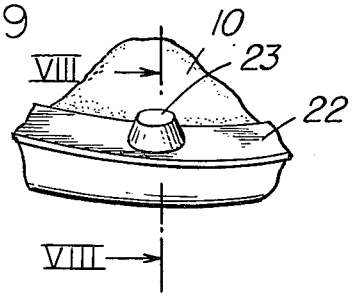
FIG. 10
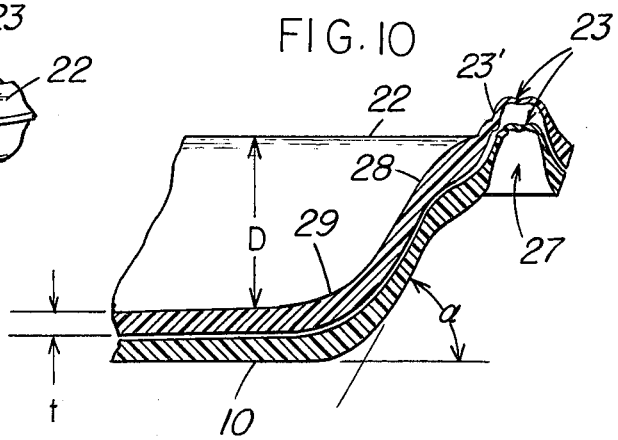
FIG. 11
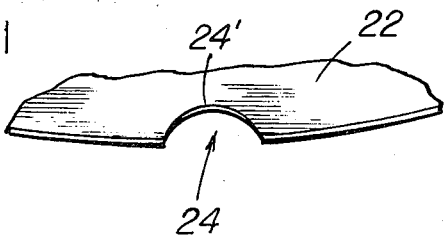
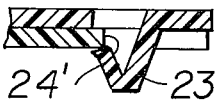
FIG. 12

NESTING INSULATED HOT-OR-COLD FOOD TRAY

FIELD OF THE INVENTION

The present invention relates to food tray structures, and more particularly to such structures intended for the temporary storage, or transport, of hot or cold foods, to prevent the food contents from approaching the temperature of the ambient surroundings. The present invention is particularly applicable to store and transport food subject to breakage and having a substantially flat area, such as hot pizzas, or cold desserts, particularly applied to pie crusts, or the like.

BACKGROUND OF THE INVENTION

Hot or cold foods, particularly items which are intended for later consumption, are frequently transported, and temporarily stored in cardboard or in chipboard boxes, the size of which is matched roughly to the maximum dimension of the items to be packaged. The shape of the box often is different from that of the item, i.e., the box is usually square, although the item is round. The cardboard boxes are usually shipped flat, to be erected on the spot, thus saving in storage and shipping space. The boxes are not intended for re-use, and are therefore made of a thin and inexpensive paper material, just strong enough to provide some protection of the contents from ambient influences, such as dust, dirt and, of course, heat exchange. Such boxes frequently, when erected, take up a volume which is substantially in excess of that required by the food items themselves. Their fragile and flimsy nature, even when erected, contributes little to the support of the food contents which may require further support on trays or carriers, lest the contents break. This is particularly true for large items based on pie crusts, such as hot pizzas, cold desserts including pie crusts and the like. It has previously been proposed (see, for example, U.S. Pat. No. 2,845,104) to make carriers for food items of relatively hinged parts, so that a chamber is formed within which small food items, such as hamburgers and the like can be carried, the hinged portions being folded together and locked along the rim edges to provide a substantially closed container. In food preparation establishments, storage space for containers to be handed to customers, and thus used at a substantial rate, is usually at a premium; further, economics dictate that the cost of the containers (which are customarily discarded after use) be small; yet they should be sturdy and provide the required mechanical and environmental protection while additionally having thermal insulating properties.

It is an object of the present invention to provide a thermally insulated food container, for temporary use, which is inexpensive and requires but little space for storage and shipping, which is light-weight, and yet sturdy.

SUBJECT MATTER OF THE PRESENT INVENTION

Briefly, a tray structure is formed of expanded foam plastic material, preferably polystyrene foam, and constructed to have a bottom plate surface from which an upwardly inclined rim projects, the rim terminating in a flange projecting laterally therefrom, generally in a plane parallel to the bottom surface. The flange is formed with projection and recess means, located at regularly distributed spaced intervals around the circumference thereof. The angle of inclination of the rim is selected such that cotangent $\alpha \geqq 1.5\ t/D$, where $t$ is the thickness of the material and $D$ is the depth of the tray. This relationship ensures that there is some clearance space beneath the projection of the inner edge of the rim with respect to the outer edge of the bottom plate surface of a tray therebeneath, so that nesting, and stacking of the trays is thereby ensured.

The projection and recess means may be formed as projecting tabs, defined by cut-outs or notches formed in the rim, and matching engagement notches likewise formed in the rim, and spaced circumferentially therefrom, at regular intervals. These projecting tabs, and the engagement notches may be tapered in opposite directions (with respect to the center of the tray) to permit snap-over of a tab into a notch upon inversion of one tray above the other, and locking of the trays together. The projections may, also, be formed as projecting buttons, extending perpendicularly with respect to the plate surface, and be formed or punched during manufacture of the tray, and engaging recesses or peripheral notches. A number of such notches, circumferentially engaged by the buttons, will hold superimposed trays together by frictional engagement. The stiffness of the tray structures as well as the frictional engagement of the rim surfaces with respect to each other hold the trays in engagement.

In accordance with a feature of the invention, the tray structure is so made that it has internally projecting ribs. If a hot food item, such as a hot pizza, is placed on the tray, the ribs raise the hot pizza crust, to permit steam to escape from between the pizza crust and the surface of the tray, thus preventing sogginess of the crust upon storage on the tray.

BRIEF DESCRIPTION OF THE DRAWINGS

Advantages of the invention will become apparent to those skilled in the art from the following description considered in conjunction with the drawings, wherein:

FIG. 3 is a top plan view of a pizza tray in accordance with the present invention, and without ribs, which may for example form a top cover;

FIG. 4 is a fragmentary perspective view of one form of tab locking element;

FIG. 5 is a fragmentary perspective view of a notch to be engaged by the tab locking element of FIG. 4;

FIG. 8 is a perspective view of another embodiment of a pizza tray, which may be a top tray or, if formed with ribs, may be a bottom tray;

FIG. 9 is a fragmentary view of the rim of the tray of FIG. 8 illustrating an engagement button;

FIG. 10 is a sectional view along line X-X of FIG. 9, and illustrating superposition of two trays, for stacking;

FIG. 11 is a fragmentary perspective view of the rim of the tray of FIG. 8, and illustrating an engagement notch, to be engaged by a button of the tray of FIG. 8; and FIG. 12 is a fragmentary cross sectional view showing engagement of an engagement button with a notch.

DETAILED DESCRIPTION

Figure 1:
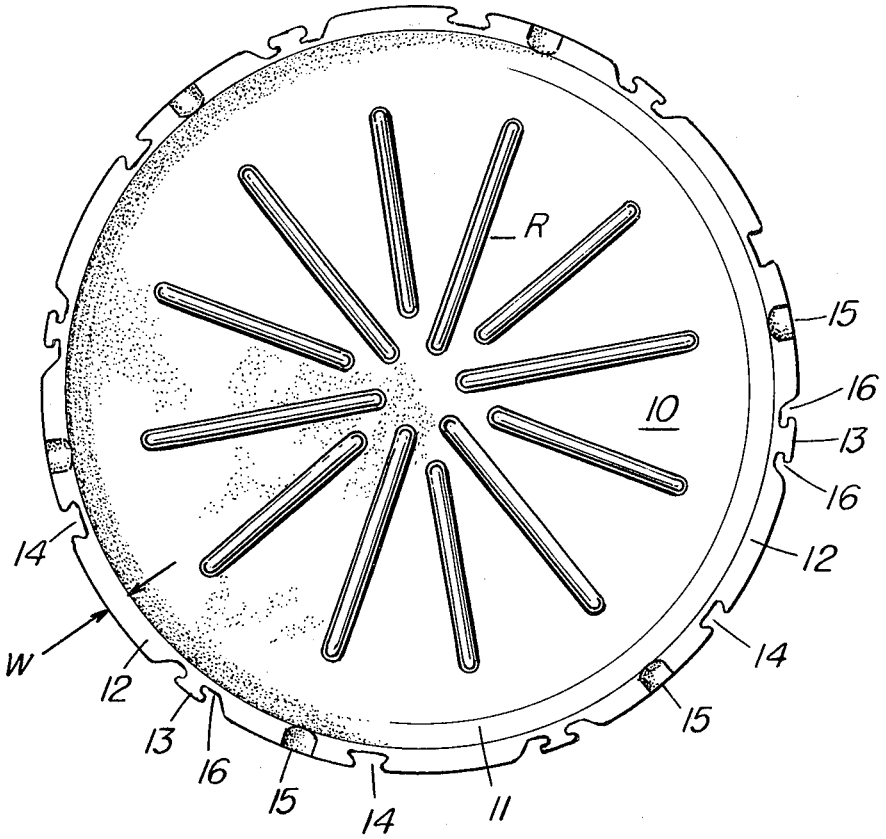
FIG. 1 is a top plan view of a pizza tray with projecting ribs to form, for example, a bottom pizza tray.

The present invention will be described in detail in connection with a pizza tray. Such a tray has a bottom plate 10 of about 20–33 cm diameter (to accept a typical 12 inch pizza), but may have any other dimension suitable for the article to be carried. It is bordered, circumferentially, by an upstanding inclined rim 11. Rim 11 terminates in a laterally projecting flange 12, having a suitable width of, for example, about 13 mm. Rim 12 is trimmed with equally spaced projecting tabs 13 (see also FIG. 4). The tabs 13 may be formed by generally radially extending cuts. As seen in FIG. 4, and in a preferred form, a pair of notches 16 are cut into the rim 12, leaving tabs 13 extending between the notches. The tabs 13 taper outwardly. Spaced from tabs 13 are notches 14 (FIG. 5), tapering inwardly. For a rim width W of about 13 mm, tabs 13 preferably increase from a minimum of about 15 mm width to a maximum of about 18 mm width; the notches 14 taper from a maximum of about 18 mm width to a minimum of about 15 mm width. These dimensions are not absolute, but are approximate, and have been found to provide secure engagement of pizza trays formed of foamed polystyrene, without undue weakening of the rims, or substantial danger of break-off of the tabs when shipping, handling and storing the trays. The relationship of the sizes of the tabs 13 to the notches 14 is relatively critical, however, since tabs which taper inwardly too much are apt to break; if the notches, on the other hand, are too large, the trays may not interlock securely.

The thickness of the material, dimension *t* in FIG. 4, is in excess of 1 mm, preferably in the range of from 1.5 mm to 3.5 mm, in order to provide sufficient stength, stiffness, and heat insulating properties without, however, becoming costly or heavy.

If the trays are used to hold hot food, such as pizzas fresh from an oven, a great deal of moisture is given off as the pizza cools. To exhaust this moisture, and avoid a condition whereby the pie crust might absorb an excess of moisture and become soggy, the rims 12 are additionally formed with flutes 15, located between the notches and the tabs. These flutes may, for example, be placed approximately midway between a projection, such as a tab 13, and a notch, such a a notch 14. These flutes, acting in the form of corrugations, increase the stiffness of the rim and hence of the tray; additionally, particularly when pizza fresh from the oven is to be packed in the tray, with another similar tray inverted thereover, the flutes permit the escape of steam between the rims and alleviate the formation of condensation at the inside of the trays. The steam, forming a slight overpressure within the chamber formed by one tray inverted over another prevents the ingress of air. The flutes are preferably shallow, for example a few millimeters deep and in the order of 1 cm across at their widest point so that, upon cessation of steaming, there will be little exchange of ambient air, or possible contamination, between the inside chamber formed by a pair of mutually inverted trays and outside, ambient atmosphere.

Condensation of moisture at the interface between the bottom of a hot pie crust and the tray itself can be alleviated by forming the top surface of the bottom tray with ridges or upstanding corrugations R, so that the pie crust itself will rest on the ridges, leaving a space between the plane surface of the tray 10 and the upstanding ridge R. These ridges may project from the plane surface by a distance of a few millimeters. Preferably, they are arranged in radially outward direction, as shown in FIG. 1, to provide for channels which extend towards the flutes 15 and permit egress of steam from beneath the pie crust, and above the top surface of the tray.

Figure 2:
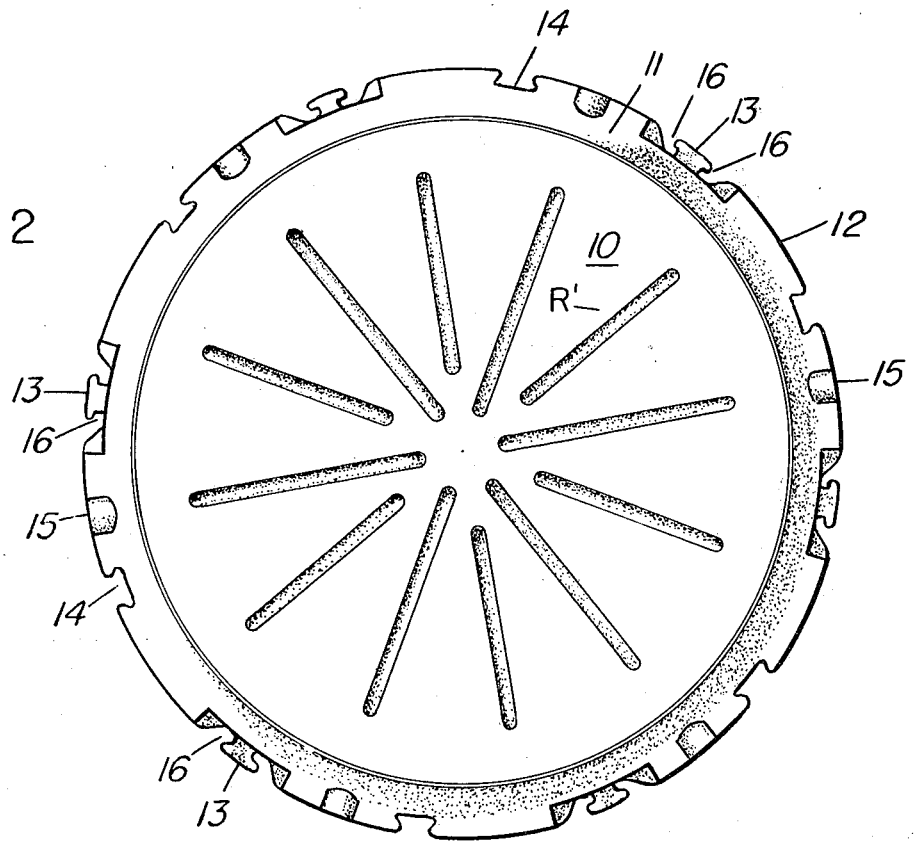
FIG. 2 is a bottom plan view of the tray of FIG. 1.

The ridges or projections R in the bottom tray may be formed by deforming the bottom tray surface, so that the ridges are corrugations, appearing as shallow depressions R′ in the bottom surface of the bottom tray (FIG. 2). The orientation, the shape, and the direction of these ridges are not critical, although a radial orientation, as shown in FIGS. 1 and 2 is preferred. These ridges also contribute to the stiffness of the bottom of the tray.

Figure 6:
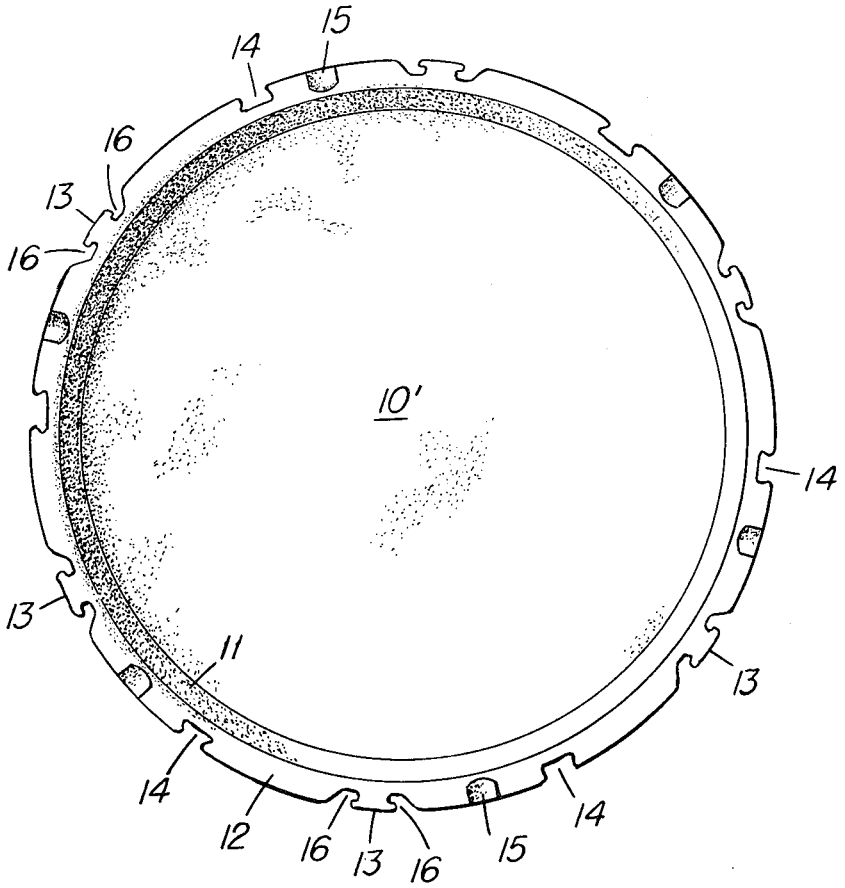
FIG. 6 is a plan view of a pizza tray, without ribs.
Figure 7:
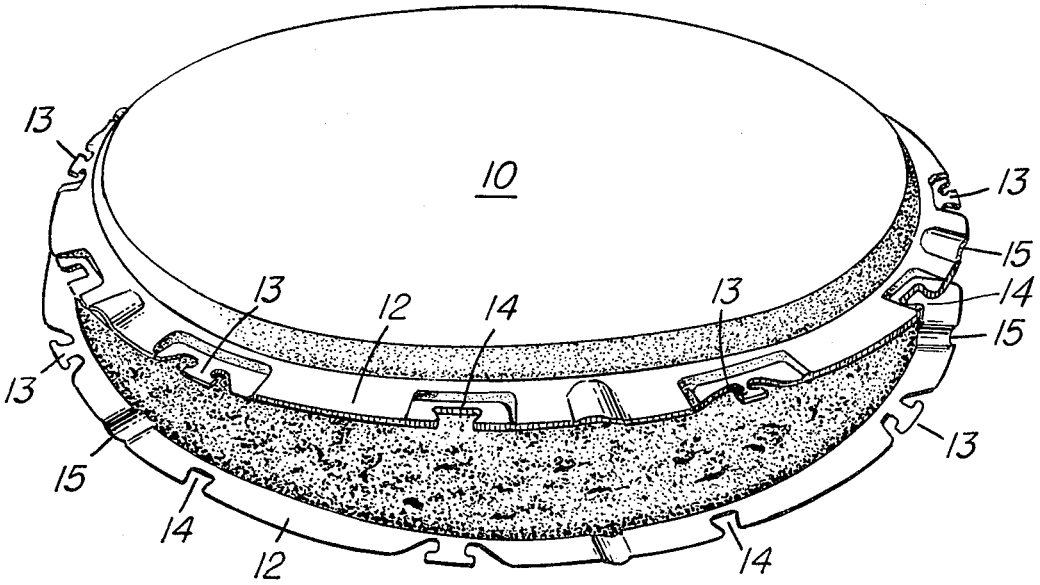
FIG. 7 is a perspective view, showing two superimposed trays of the type shown in FIG. 1 or 3, relatively inverted, the bottom tray holding a pizza.

The same trays, with ridges therein, may be used for the bottom and the top to form a closed container (see FIG. 7). The top tray need not have the ridges, however, but may have a smooth bottom surface 10′ (FIG. 6) without ridges or corrugations formed therein.

The interlocking projection and recess means may also be formed to project in a direction approximately perpendicular to the major plane of the tray. Referring to FIG. 8, projecting buttons 23 extend from the edge of flange 22 to engage notches 24 formed at the flange thereof. Flutes 15 similar to those shown in FIG. 1 are also formed in the tray of FIG. 8; likewise, the tray of FIG. 8 may have ridges R (not shown). The buttons 23 are punched outwardly (FIG. 10) to form, at the underside of the tray, matching depressions 27. When the trays are stacked, buttons 23 of one tray will fit into the notches 27 of the next tray thereabove. The angle of inclination $\alpha$ (FIG. 10) is so selected that the cotangent of $\alpha$ is greater than 1.5 $t/D$, to ensure that the projection of the edge 28 of the rim of any one tray will fall beyond the projection of the inner edge 29 of the plane surface of the tray therebeneath. This ensures nonbinding stacking and nesting of trays which can thus be superimposed, to minimize storage space. The depth dimension D is shown in FIG. 10; the width W of the flange 12 is shown in FIGS. 1 and 6.

A plurality of trays can be manufactured by hot forming and stamping from foamed or otherwise expanded polystyrene sheet material. The trays can be formed and punched in one operation, with or without the ridges R (FIG. 1). For shipping, the trays are stacked above each other, for example in the alignment shown in FIG. 10. If the ridges are not in alignment, there will be somewhat greater separation between superimposed trays than that shown in FIG. 10. If the embodiment of FIG. 8 is used, buttons 23 will fit within the recesses 27, formed by punching the buttons beneath the flange 22.

In use, two such trays, or one tray having ridges R (FIG. 1) and one tray without ridges (FIG. 6) is removed from storage, a pizza is placed on the bottommost tray, that is, the one with the ridges R, and the other tray is inverted and placed thereover, with the tabs 13 aligned with notches 14 (or buttons 23 aligned with notches 24, respectively). The tabs 13 are then forced through the notches 14 or, if the embodiment of FIG. 8 is used, the buttons 23 need merely be aligned with and snapped into the notches 24. The circumferential placement of buttons 23 is not critical if a sufficient number of buttons and notches are provided, located around the circumference, to hold the trays in circumferential alignment and position. The distance of the surface 23′ (FIG. 10) of the buttons 23 from the center of the tray should be slightly less than the distance of the edge 24′ (FIGS. 8, 11) from the center of the plate, so that, upon engagement of the buttons 23 with the notches 24, the buttons fit perfectly into the notches or fit with a slight degree of interference, that is, require snapping of the buttons into the notches. To provide for positive engagement, the buttons 23 may be shaped, in cross section adjacent their root, to be other than circular, for example to have a thinner wall thickness at the contact point of the button with the wall 24′ of the notch 24, so that the wall at the button is susceptible to indentation, or undercutting by the surface 24′, thus forming a lock (see FIG. 12). Suitable cross-sectional configuration for a button would be, for example, diamond or square shape, as seen at button 123 in FIG. 8, the remaining buttons 23 being shown schematically.

Preferably, at least three interengaging projection and recess means are used, the number depending on the diameter of a tray. For a pizza tray of about 30 cm diameter, four or more (preferably five or six) interengaging recess and projection means are provided. If the embodiment of FIGS. 1–5 is used, not all the tabs need be engaged, and if the one or the other tab should break, there will be sufficient tabs left to provide for tight engagement of two such tray structures, which provide a hollow food-containing chamber therebetween to effectively exclude outside atmospheric contamination and heat exchange, such as heat loss from hot foods, or warming if cold foods are contained therein.

The height of the ribs R above the plane top surface of the tray 10 should be dimensioned in view of these factors: tray stacking height, tray strength, food temperature maintenance, ease of placing the food item, for example a pizza into the tray, and manufacturing capability. The actual configuration of the projections R as radially extending ribs, rings, curved bars, or other shapes which provide a channel, pocket, chamber, or the like to lift the pizza off the bottom tray surface is not critical.

The important feature is, however, to provide projecting elements to separate the bottom surface of the pizza, or other food item, from the major extent of the tray surface.

None of the dimensions given above are critical, but they have been found to be desirable, particularly if the trays are used to hold pizzas. A suitable angle $\alpha$ for a dimension D of about 13 – 30 mm is about 60°. This angle provides a lateral offset at points 28, 29 (FIG. 10) of about 9 mm which, for a wall thickness $t$ of about 2 mm, is about 4.5 times wall thickness. Such trays which, with their lateral flanges 12, 22, respectively, have an overall diameter of about 37½ cm, are sturdy and strong and can carry even a fragile item such as a pizza while maintaining the pizza at elevated temperature for a sufficient period of time to permit temporary storage, or delivery under usual commercial conditions. Forming the trays, additionally, with projections R to lift the bottom of a food item off the major extent of the tray permits ventilation, and escape of condensation moisture from beneath the food item, typically the pizza, and escape of steam through the flutes 15.

Various changes and modifications may be made within the scope of the inventive concept and particularly to adapt the tray structure to the foods to be used therewith. Features described in connection with any one embodiment may, suitably, be used with any other embodiment. The application has been described specifically for a pizza tray, in which the material is foamed, moldable material such as foamed polystyrene. Other materials may also be used such as molded pulp. Foamed plastic materials such as expanded polystyrene are particularly suitable due to their light weight, strength and excellent heat insulating properties.

We claim:

1. Insulated hot or cold food tray for temporarily storing and transporting food items at temperatures different from ambient temperatures comprising an integral dished tray structure of molded material having a bottom plate surface (10);

a surrounding rim (11) formed to incline upwardly with respect to the bottom plate surface;

and a flange (12) laterally projecting from the rim generally in a plane parallel to said bottom surface (10);

the angle of inclination of the rim being selected such that cotangent $\alpha$ is at least 1.5 $t/D$ wherein $\alpha$ equals angle of inclination; $t$ equals wall thickness of the foamed plastic material and $D$ equals depth of the tray structure and corresponding to the distance from the top of the flange (12) to the top of the bottom plate surface (10);

said flange (12) being formed with projection and recess means (13, 14; 23, 24) located at regularly distributed spaced intervals around the circumference thereof, the projection means have portions which have a dimension which is greater than the dimension of the recess means (14, 24) at equal spacing from the surrounding rim (11), inversion of one tray over another and engagement of the projection means of one tray in the recess means of the inverted, opposite tray permitting fitting of said flanges together and locking the projection means of one tray through the recess means of the other to engage the flange of the other tray from the face opposite that facing the first tray to provide an insulated storage and transport carrier to transport food items in the chamber formed by the inverted, engaged trays with the flanges of the trays locked together by overlapping engagement of the respective projection means of one tray behind the flanges of the other tray;

wherein the projection of the projection and recess means comprises an outwardly tapering tab (13) and inwardly tapering notches (16) formed adjacent both sides of each tab and separating the tab from the surrounding flange area;

and the recess means of the projection and recess means comprises an inwardly tapering engagement notch (14), the maximum dimension of the engagement notch lying between the minimum and maximum dimension of the tab, the taper of said tab, and said engagement notches, respectively, being from about 15 mm to 18 mm, and the rim having a width (W) of about 13 mm.

2. Tray according to claim 1, wherein depressed flutes (15) are formed in the flange (12) at spaced locations around the circumference thereof;

and the plate surface of the tray is formed with radially extending ridges (R) to elevate the food item above the plate surface, to provide a vent space from beneath the food item and out of the chamber formed by flutes when the trays are inverted over each other to permit venting of steam or condensation, moisture when hot food items are enclosed in a tray pair.

3. Tray according to claim 1 wherein the projection of the projection and recess means comprises an outwardly tapering tab (13) and notches (16) formed adjacent both sides of each tab and separating the tab from the surrounding flange area.

4. Tray according to claim 1 wherein the rim has a width (W) of about 13 mm; the engagement notches taper from about 15 mm to 18 mm, and the tabs taper from about 15 mm to 18 mm.

5. Tray according to claim 2 wherein the projections comprise radially extending ridges (R) formed as corrugations in the bottom plate surface and providing depressed grooves (R′) beneath said surface.

6. An enclosed, heat-insulated disposable food carrier comprising two food trays as claimed in claim 1, one tray being inverted over the other to form a heat-insulated chamber between the trays, said trays being interlocked together by engagement of the tabs of one tray into and through the engagement notches of the other tray, and behind the flange portions adjacent the engagement notches of said other tray, and the tabs of the other tray into and through the engagement notches of said one tray and behind the respective flange portions adjacent the engagement notches of said one tray.

7. Insulated hot or cold food tray for temporarily storing and transporting food items at temperatures different from ambient temperatures comprising an integral dished tray structure of molded material having a bottom plate surface (10);

a surrounding rim (11) formed to incline upwardly with respect to the bottom plate surface;

and a flange (12) laterally projecting from the rim generally in a plane parallel to said bottom surface (10);

the angle of inclination of the rim being selected such that cotangent $\alpha$ is at least 1.5 $t/D$ wherein $\alpha$ equals angle of inclination; $t$ equals wall thickness of the foamed plastic material and $D$ equals depth of the tray structure and corresponding to the distance from the top of the flange (12) to the top of the bottom plate surface (10);

said flange (12) being formed with projection and recess means (13, 14; 23, 24) located at regularly distributed spaced intervals around the circumference thereof, the projection means have portions which have a dimension which is greater than the dimension of the recess means (14, 24) at equal spacing from the surrounding rim (11), inversion of one tray over another and engagement of the projection means of one tray in the recess means of the inverted, opposite tray permitting fitting of said flanges together and locking the projection means of one tray through the recess means of the other to engage the flange of the other tray from the face opposite that facing the first tray to provide an insulated storage and transport carrier to transport food items in the chamber formed by the inverted, engaged trays with the flanges of the trays locked together by overlapping engagement of the respective projection means of one tray behind the flanges of the other tray;

wherein the projection means of the projection and recess means comprises buttons (23) formed on the flange (22) and projecting from the major plan thereof;

and the recess means comprises notches (24) formed in the periphery of the rim and shaped to at least in part surround the buttons (23); the surface (23′) of the button (23) facing the center of the tray being slightly closer to the center of the tray than the surface (24′) of the notch closest to the center of the tray the thickness of the material of the button (23) adjacent said surface (23′) facing the center of the tray is reduced to permit indentation or undercutting of the button when the button (23) of one tray is engaged in the notch (24) of another tray inverted thereover to result in overlap, or bulging over of the button (23) beneath the flange formed with the notch (24).

8. Tray according to claim 7, wherein depressed flutes (15) are formed in the flange (12) at spaced locations around the circumference thereof;

and the plate surface of the tray is formed with radially extending ridges (R) to elevate the food item above the plate surface, to provide a vent space from beneath the food item and out of the chamber formed by flutes when the trays are inverted over each other to permit venting of steam or condensation, moisture when hot food items are enclosed in a tray pair.

9. An enclosed, heat insulated disposable food carrier comprising two food trays as claimed in claim 7, one tray being inverted over the other to form a heat insulating chamber between the trays, said trays being interlocked together by engagement of the buttons of one tray into and through the notched of the other tray, and behind the flange portions adjacent the notches of said other tray by undercutting of the material of reduced wall thickness of the button by said adjacent flange portions of said other tray, and the buttons of the other tray into the notches of said one tray and behind the respective flange portions adjacent the notches of said one tray, by undercutting the buttons in the region of reduced thickness of material by said adjacent flange portion of said one tray.

* * * * *